United States Patent [19]

Haga et al.

[11] Patent Number: 4,691,551

[45] Date of Patent: Sep. 8, 1987

[54] ROLLING METHOD AND ROLLING TOOLS

[75] Inventors: Minoru Haga; Shinobu Kaneko; Shoji Ikawa; Kimimasa Murayama; Yasuhide Nakamura; Mitsuo Saito, all of Aichi, Japan

[73] Assignees: Toyota Jidosha Kabushiki Kaisha, Toyota; OSG Mfg. Company, Hoi, both of Japan

[21] Appl. No.: 759,445

[22] Filed: Jul. 26, 1985

[51] Int. Cl.[4] ..... B21H 3/06

[52] U.S. Cl. ..... 72/88; 72/469

[58] Field of Search ..... 72/88, 90, 469, 104, 72/108, 365

[56] References Cited

U.S. PATENT DOCUMENTS

| | | | |
|---|---|---|---|
| 446,739 | 2/1891 | Jones | 72/469 |
| 470,805 | 3/1892 | Jones | 72/90 |
| 2,232,337 | 2/1941 | Meersteiner | 72/88 |
| 2,293,930 | 8/1942 | Braendel | 72/88 |
| 2,760,388 | 8/1956 | Seibert | 72/88 |
| 3,260,100 | 7/1966 | Wieber | 72/88 |

FOREIGN PATENT DOCUMENTS

| | | | |
|---|---|---|---|
| 1453709 | 9/1966 | France | 72/90 |
| 39437 | 3/1984 | Japan | 72/469 |

*Primary Examiner*—Daniel C. Crane

*Attorney, Agent, or Firm*—Cushman, Darby & Cushman

[57] ABSTRACT

Serration rolling tools and thread rolling tools each having groups of leading teeth, finishing teeth and disengaging teeth are provided, a lead angle of the thread rolling tool being set in accordance with the rolling diameter of the serration section in a work piece. The thread rolling tool and serration rolling tool are arranged parallel and integrally. First a rolling operation for forming serrations is started by the serration rolling tools, a rolling operation for forming threads being started by the thread rolling tools in the course of the rolling operation by the group of the leading teeth of the serration rolling tools. A rolling operation for finishing the threads is completed in the latter half of the rolling operation by the group of the finishing teeth for the serrations. The difference in rolling diameters is absorbed by the slide of the aforesaid thread rolling tools on a shaft member (work piece), thus enabling the simultaneous formation of serrations and threads in a short rolling stroke.

8 Claims, 7 Drawing Figures

ROLLING METHOD AND ROLLING TOOLS

BACKGROUND OF THE INVENTION

1. Field of the Invention

The present invention relates to a method and tools by which serrations and threads which are different in rolling diameter from each other are formed simultaneously on a shaft member (workpiece) by rolling.

2. Description of the Prior Art

One of the examples of shaft members having serrations and threads different in rolling diameter from each other is a steering shaft of an automobile as shown in FIG. 1. In this figure, serrations 2 and threads 3 are formed successively in one end portion of a steering shaft denoted by 1. A steering wheel 4 having serrations in the inside diameter is fitted, with its phase determined in the rotational direction, to said steering shaft 1, and is fixed by a nut 5.

In order to form those serrations and threads different in rolling diameter from each other by rolling, such a method as shown in FIG. 2 has been applied generally, in which: serration rolling tool 6 and thread rolling tool 7 set in different positions and combined serially with each other are provided in a pair, and each part of the pair is moved in the direction of an arrow A toward a shaft member 9 supported by two centers 8.

The above-described relationship in arrangement between serration rolling tool 6 and thread rolling tool 7 requires a large rolling stroke and, consequently, a large rolling machine, which increases the cost of equipment. Moreover, according to the foregoing method, serrations and threads are formed, strictly speaking, in separate rolling processes, which causes other problems in that an improvement in productivity, the greatest advantage of rolling machining, and the reduction of cost cannot be fully effected.

For the purpose of overcoming the above problems, there has been a trial in which the aforesaid serration rolling tool 6 and the thread rolling tool 7 are arranged in parallel so that the rolling operation with those tools can be performed simultaneously. According to this method, however, extra axial tension is generated during the rolling operation, because a prescribed lead angle $\alpha$ (FIG. 2) of the thread rolling tool is formed in accordance with the elements in the form of a rolled article in this case, and said tension works so as to hinder rolling for forming serrations, in particular, thus causing a failure in forming a prescribed number of the teeth of a serration, including the lack or excess thereof. Therefore, this method as not been applied in practice.

SUMMARY OF THE INVENTION

Designed in view of the above-described problems, the present invention provides a rolling method and rolling tools which enable simultaneous rolling for forming serrations and threads of different rolling diameter, thereby reducing the size of the rolling machine and improving the productivity thereof.

The rolling method of the present invention is characterized in that rolling for forming serrations is started first, then rolling for forming threads is started with a lead angle set in accordance with the rolling diameter of the serrated portion of a workpiece in the course of rolling for forming the serrations, and rolling for forming the threads is ended in the latter half of the rolling operation for finishing the serrations.

The rolling tools of the present invention are characterized in that they comprise serration rolling tools and thread rolling tools each of which is provided with groups of leading teeth, finishing teeth and disengaging teeth, said thread rolling tooth being formed to have a lead angle set in accordance with, or as a function of, the rolling diameter of serrations, and said thread rolling tool and the aforesaid serration rolling tool being arranged parallel and integrally in such a manner that the starting end of the group of the leading teeth of the thread rolling tool is positioned in the intermediate portion of the group of the leading teeth of the serration rolling tool, while the terminal end of the group of the finishing teeth of said thread rolling tool is positioned in the latter half portion of the group of the finishing teeth of said serration rolling tool.

It is desirable that the terminal end of the group of the finishing teeth of the thread rolling tool is positioned at a thread finishing point, which is located a distance of about 1.5 times the rolling diameter of the serration rolling tool from the terminal end of the group of the finishing teeth of the serration rolling tool.

According to the above-described rolling method in which the above-stated rolling tools are employed, serrations formed first by the serration rolling function act as a forced rotation driving source for the subsequent thread rolling. Owing to the difference in rolling diameter, the thread rolling tool turns out to slide on a shaft member (workpiece), so that threads having a desired lead angle are formed gradually by rolling. On the other hand, the thread rolling tool runs off in the latter half of rolling for finishing serrations, and rolling of the serrations can be completed without being affected by the thread rolling.

In consequence, the serration rolling tool and the thread rolling tool exert no adverse interaction on each other, thus enabling the formation of threads and serrations of high precision. Moreover, the simultaneous rolling of these tools enables a remarkable improvement in productivity.

Furthermore, the parallel arrangement of the serration rolling tool and the thread rolling tool realized by the present invention enables the decrease in a rolling stroke. Thereby the rolling machine can be made small, and also the expenses invested in equipment can be reduced effectively.

DETAILED DESCRIPTION OF THE INVENTION

An embodiment of the present invention will be described hereunder with reference to the attached drawings.

Figure 3:
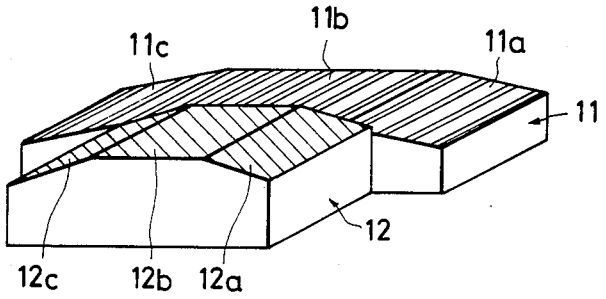
FIG. 3 is a perspective view showing the external form of rolling tools of the present invention.
Figure 4:
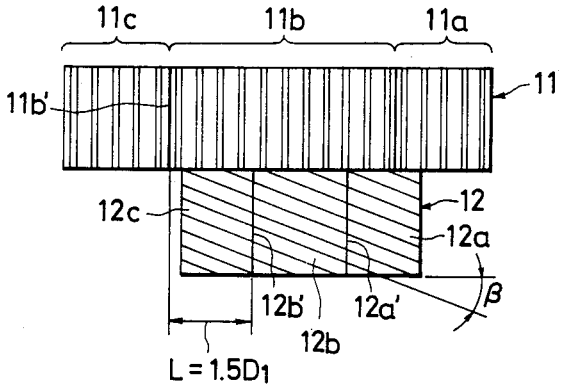
FIG. 4 is a plan view showing same.

FIGS. 3 and 4 show the external forms of rolling tools of the present invention. In these figures, numeral 11 denotes a serration rolling tool and 12 a thread rolling tool. The two tools are arranged in parallel, and are incorporated integrally in a rolling machine. The serration rolling tool 11 and the thread rolling tool 12 comprise groups 11*a* and 12*a* of leading teeth, groups 11*b* and 12*b* of finishing teeth and groups 11*c* and 12*c* of disengaging teeth, respectively, and these tools are positioned in a prescribed interrelational arrangement. More specifically, the beginning or leading end of the group 12*a* of the leading teeth of the thread rolling tool 12 is positioned in the intermediate portion of the group 11*a* of the leading teeth of the serration rolling tool 11, and the beginning end 12*a*′ of the group 12*b* of finishing teeth of the thread rolling tool 12 is positioned adjacent the first half of the group 11*b* of finishing teeth of the serration rolling tool 11. The terminal end 12*b*′ of the group 12*b* of the finishing teeth of the tool 12 is positioned ahead of the terminal end of the group 11*b* of the finishing teeth of the serration rolling tool 11 by a prescribed distance L.

Figure 5:
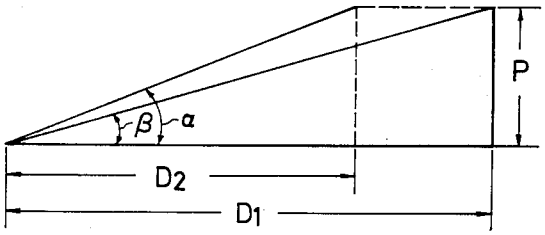
FIG. 5 is an illustration of a method for setting a lead angle of a thread rolling tool.

Moreover, a lead angle $\beta$ of the thread rolling tool 12 is compensated in accordance with the rolling diameter of a serration. In more detail, a thread pitch P is taken in relation to the rolling diameter $D_1$ of the serration, and the lead angle $\beta$ is determined from the angle of inclination thereof, as shown in FIG. 5. Thus, the following equalities can be stated:

$$\tan B = \frac{P}{\pi D_1} \text{ or } B = \tan^{-1}\frac{(P)}{\pi(D_1)};$$

Figure 1:
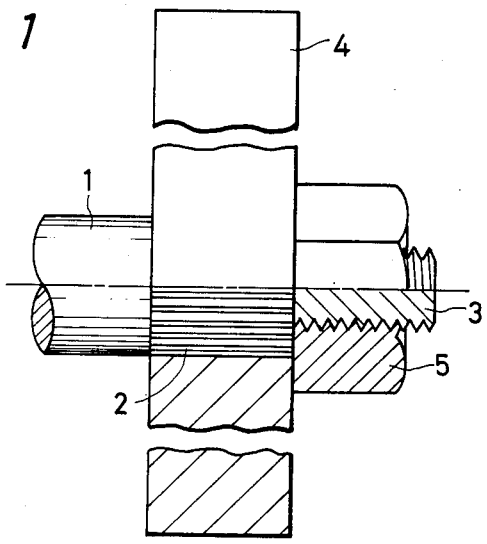
FIG. 1 is a sectional view of the principal part of an example of application of a shaft member which has serrations and threads of different rolling diameter.
Figure 2:
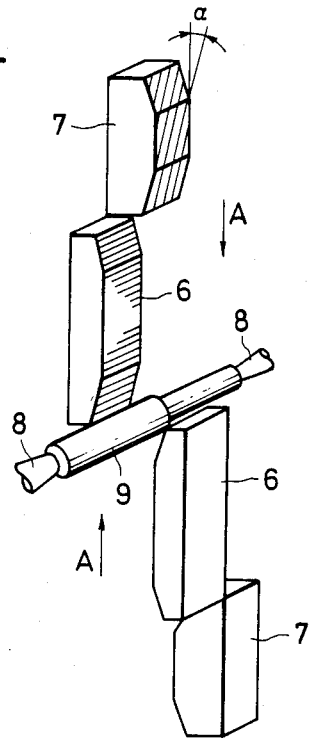
FIG. 2 PRIOR ART
FIG. 2 is a schematic view showing a mode of rolling with conventional rolling tools.

In this connection, the lead angle $\alpha$ of the conventional thread rolling tool 7 is determined in accordance with the rolling diameter $D_2$ of a thread (see FIG. 2).

The aforesaid dimension L (shown in FIG. 4) for positioning the thread rolling tool 12 in relation to the serration rolling tool 11 is set to be about 1.5 times as large as the rolling diameter $D_1$ of the serration.

Figure 6:
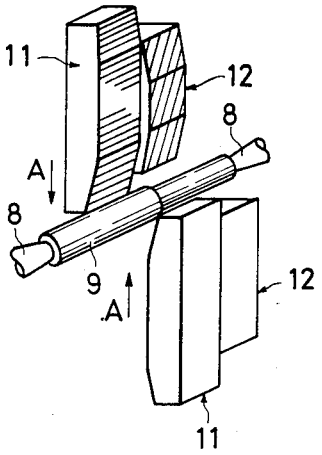
FIGS. 6 and 7 are schematic views showing a mode of the rolling operation by the present rolling tools, respectively.

The rolling tools thus constructed are arranged in a pair, as shown in FIG. 6, on the right and left sides of a rolling machine not shown in the figure. Now, when said rolling tools are moved in the directions of arrows A toward a shaft member 9 supported by two centers 8 in the same way as in the conventional example, first the serration rolling tools 11 roll on the shaft member 9 and start forming serrations. There is a region in which the rolling load decreases sharply in the course of an advance of the rolling by the leading-teeth group 11*a* of the serration rolling tool 11. When this rolling advances into said region, the thread rolling tools 12 roll on the shaft member in sync with said advance and start the rolling operation for forming thread.

Figure 7:
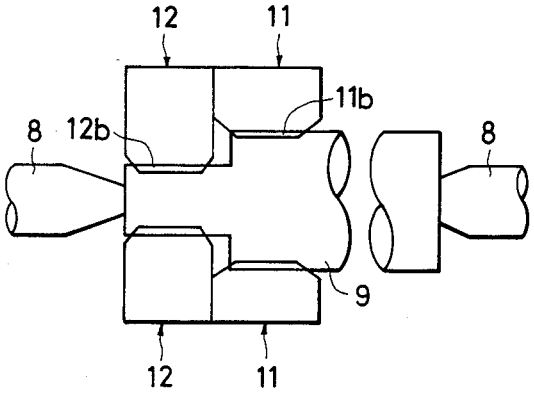

The rolling operation for forming the threads is started from serration slots already formed, which serve as a base point of the operation when the rolling load of said serrations is small and the lead angle $\beta$ of the thread rolling tool 12 is set in accordance with the rolling diameter of the serrations. Consequently, said thread rolling tools 12 begin to slide on the shaft member 9, which acts to approximate the lead angle of formed threads to a lead angle $\alpha$ matched with the elements of the form of a rolled article. Meanwhile, the rolling of serrations is also advanced, and, as shown in FIG. 7, the finishing-teeth group 11*b* of the serration rolling tool 11 and the finishing-teeth group 12*b* of the thread rolling tool 12 operate simultaneously on the shaft member 9, effecting the rolling operation.

By this operation, the threads having the prescribed lead angle $\alpha$ are finally formed on the shaft member 9. This rolling operation for finishing the threads is completed in the latter half portion of the serration rolling tool 11 in which the finishing-teeth group 11*b* thereof operate, and thereafter the thread rolling tools 12 are separated from the shaft member 9 through the operation of the disengaging teeth group 12*c* thereof. Consequently, the serration rolling tools 11 can complete their finishing rolling operations without being affected by the rolling operation for forming the threads, thus enabling the formation of serrations with high precision.

What is claimed is:

1. A rolling method for simultaneously forming serrations and threads on a workpiece having a first rolling diameter portion on which serrations are to be formed, and a second rolling diameter portion on which threads are to be formed, comprising the steps of:

rolling the workpiece; and during said step of rolling said workpiece first, beginning to form serrations on the first diameter portion of the workpiece, and second, forming threads with a lead angle set as a function of a rolling diameter of the first rolling diameter portion of the workpiece, the forming of threads being started after the step of forming serrations has begun and being completed after said forming serrations step is more than half completed and before said forming serrations step is completed.

2. A rolling method according to claim 1, wherein said forming threads step is completed at a thread finishing point which is a point located at a distance of about 1.5 times the rolling diameter of the first diameter portion from an ending point of the rolling operation for forming serrations step.

3. Method as in claim 1, wherein the lead angle is set to be an angle equal to the inverse tangent of a pitch of the threads divided by the first rolling diameter.

4. Method as in claim 1, wherein the first rolling diameter portion is of a different diameter than the second rolling diameter portion.

5. A rolling tool for forming serrations on a first portion of a workpiece having a first rolling diameter and threads on a second portion of a workpiece having a second rolling diameter comprising:

a pair of serration rolling tools facing each other;

a pair of thread rolling tools facing each other and each being integrally movable with each serration rolling tool, respectively;

each of said tools being provided with respective groups of leading teeth, finishing teeth and disengaging teeth, each group of teeth having a beginning end, a terminal end, and an intermediate portion therebetween, each said thread rolling tool being formed to have a lead angle set as a function of the first rolling diameter, and each thread rolling tool and the respective serration rolling tool movable therewith being arranged side by side, parallel and integrally with one another in such a manner that the beginning end of the leading teeth of each thread rolling tool is positioned adjacent the intemediate portion of the leading teeth of the respective serration rolling tool, and the terminal end of the finishing teeth of each thread rolling tool is positioned adjacent a latter half portion of the finishing teeth of the respective serration rolling tool, whereby the beginning end of the leading teeth of each thread rolling tool contacts the workpiece after the beginning ends of the leading teeth of the respective serration rolling tool contacts the workpiece and the terminal end of the disengaging teeth of each thread rolling tool disengages from the workpiece before the terminal end of the disengaging teeth of the respective serration rolling tool disengages from the workpiece.

6. A rolling tool according to claim 5, wherein the terminal end of the finishing teeth of the thread rolling tool is positioned at a thread finishing point, which is a point located at a distance of about 1.5 times as large as the first rolling diameter of serrations from the terminal end of the finishing teeth of the serration rolling tool.

7. An apparatus according to claim 5, wherein said lead angle is set to be an angle equal to the inverse tangent of a pitch of the threads divided by the first rolling diameter.

8. An apparatus according to claim 5, wherein the first rolling diameter is of a different size than the second rolling diameter.

* * * * *